US012221756B1

(12) United States Patent
Su et al.

(10) Patent No.: US 12,221,756 B1
(45) Date of Patent: Feb. 11, 2025

(54) DREDGING AND DRAINAGE STRUCTURE FOR IRRIGATION AREA

(71) Applicant: Zhejiang Institute of Hydraulics & Estuary(Zhejiang Institute of Marine Planning and Design), Hangzhou (CN)

(72) Inventors: Longqiang Su, Hangzhou (CN); Jinhua Wen, Hangzhou (CN); Shuiping Yao, Hangzhou (CN); Shang Gao, Hangzhou (CN); Chenbin Jiang, Hangzhou (CN); Helong Wang, Hangzhou (CN); Yi Shi, Hangzhou (CN); Caiming Chen, Hangzhou (CN); Qifeng Li, Hangzhou (CN); Ming Wen, Hangzhou (CN)

(73) Assignee: Zhejiang Institute of Hydraulics & Estuary(Zhejiang Institute of Marine Planning and Design), Hangzhou (CN)

( * ) Notice: Subject to any disclaimer, the term of this patent is extended or adjusted under 35 U.S.C. 154(b) by 0 days.

(21) Appl. No.: 18/890,910

(22) Filed: Sep. 20, 2024

(30) Foreign Application Priority Data

May 14, 2024 (CN) ..... 202410593913.2

(51) Int. Cl.
*E02B 13/00* (2006.01)
*E02B 3/02* (2006.01)

(52) U.S. Cl.
CPC ..... *E02B 13/00* (2013.01); *E02B 3/023* (2013.01)

(58) Field of Classification Search
CPC ..... E02B 3/023; E02B 13/00; E02B 8/02
See application file for complete search history.

(56) References Cited

U.S. PATENT DOCUMENTS 2,442,358 A * 6/1948 Harp ..... E02B 8/02 210/170.1
4,074,535 A * 2/1978 Schoonmaker ..... E02F 3/8808 405/52

(Continued)

FOREIGN PATENT DOCUMENTS

CN 1072232 A 5/1993
CN 2758332 Y 2/2006

(Continued)

OTHER PUBLICATIONS

Shanxi Water Conservancy Science and Technology, No. 01. date of issue: Feb. 20, 2017. WU Zhengbing; Analysis on the Canal Silting Problems and Study on the Silting-reducing Measures in the Yellow River Water Diversion Irrigation District. Full text Claims involved: 1-8.

*Primary Examiner* — Janine M Kreck
(74) *Attorney, Agent, or Firm* — Kaplan Breyer Schwarz LLP

(57) ABSTRACT

A self-acting dredging and drainage structure for a plain river network irrigation area is provided. The structure includes a first tube body, a water inlet end side of the first tube body is provided with a trash rack, a partition body is provided in the first tube body, and a water outlet end side of the first tube body is provided with a contraction and diversion device. The contraction and diversion device divides a water outlet end of the first tube body into an upper water outlet side and a lower water outlet side, and the contraction and diversion device includes no less than one arranged contraction and diversion pipe; and the upper water outlet side has first water outlets and second water outlets.

8 Claims, 7 Drawing Sheets

(56) References Cited

U.S. PATENT DOCUMENTS

| | | | | |
|---|---|---|---|---|
| 9,797,107 | B1 * | 10/2017 | Huang | E02B 9/06 |
| 10,094,091 | B1 | 10/2018 | Tesvich | |
| 10,233,602 | B2 * | 3/2019 | Huang | E02B 9/022 |

FOREIGN PATENT DOCUMENTS

| | | | |
|---|---|---|---|
| CN | 107816076 | A | 3/2018 |
| CN | 207392286 | U | 5/2018 |
| CN | 113338244 | A | 9/2021 |
| JP | 2003247221 | A | 9/2003 |
| JP | 2018071104 | A | 5/2018 |
| JP | 6997512 | B2 | 1/2022 |

* cited by examiner

DREDGING AND DRAINAGE STRUCTURE FOR IRRIGATION AREA

CROSS-REFERENCE TO RELATED APPLICATIONS

This application claims priority to Chinese Patent Application No. 202410593913.2, filed on May 14, 2024, the contents of which are hereby incorporated by reference.

TECHNICAL FIELD

The present disclosure belongs to the technical field of farmland water conservancy, and in particular to a self-acting dredging and drainage structure for a plain river network irrigation area.

BACKGROUND

The existing dredging and drainage structure for irrigation area needs to periodically remove the siltation on the bottom plate at the drainage outlet or replace the silt box by manual or mechanical equipment. Because the dredging process or replacing the silt box may only be carried out after the drainage in the irrigation area is finished, the drainage efficiency of the irrigation area will be reduced if the siltation is serious or the silt box is full during the drainage process, which will aggravate the siltation in the drainage outlet, make it impossible to achieve self-acting dredging and increase the labor cost.

In the prior art, for example, Japanese Patent NO. 6997512B2, titled "DREDGING INTAKE STRUCTURE", solves the problem that the traditional dredging water intake structure can not sink into the water bottom too much, the amount of silt flowing into the dredging water intake structure is small, so the silt may not be effectively dredged. This patent provides a dredging suction structure, which has an upper surface, a rear surface arranged at the rear end of the upper surface in the traveling direction, a side surface, a suction port arranged near the lower end of the rear surface for sucking the silt to be dredged, and a fence having a gap from the front end of the top surface to the lower end of the rear surface that is smaller than the inner diameter of the air inlet so as to prevent objects of a size that would block the inlet from entering the inlet. However, this patent aims to clean the silt, but may not solve the problem of silt cleaning from the root.

SUMMARY

An objective of the present disclosure is to provide a self-acting dredging and drainage structure for a plain river network irrigation area with simple structure, high drainage efficiency and good scouring and siltation effect.

The technical solution adopted by the present disclosure for achieving the above objective is as follows.

A self-acting dredging and drainage structure for a plain river network irrigation area, including a first tube body. A water inlet end side of the first tube body is provided with a trash rack, a partition body is provided in the first tube body, and a water outlet end side of the first tube body is provided with a contraction and diversion device. The contraction and diversion device divides a water outlet end of the first tube body into an upper water outlet side and a lower water outlet side, and the contraction and diversion device includes contraction and diversion pipes arranged no less than one. The upper water outlet side has first water outlets and second water outlets, ends of the contraction and diversion pipes are arranged in one-to-one correspondence with the first water outlets, and other ends of the contraction and diversion pipes are all connected with a connecting pipe.

According to an embodiment of the present disclosure, a sidewall of the first tube body adjacent to the lower water outlet side has an inclined plane.

Through the overall design of the self-acting dredging and drainage structure for the plain river network irrigation area, the trash rack is in front of the water inlet end of the first tube body, which may intercept the waste such as leaves and plastics in the irrigation area, prevent the waste from entering the first tube body and blocking the first tube body, and the waste may be collected and cleaned manually at intervals. The first water outlets on the upper water outlet side are arranged in one-to-one correspondence with the contraction and diversion pipes, so that the water discharged from the first water outlets may be discharged along the contraction and diversion pipes. It should be noted that the water outlet of each contraction and diversion pipe faces the drainage direction of the lower water outlet side of the first tube body, and the contact surface between an inner wall of the each contraction and diversion pipe and the water is in the form of streamlined or parabolic or other forms of slowing down the water flow resistance, which may realize the contact between the water and the pipe wall and improve the flow velocity of the water to the water outlet of each contraction and diversion pipe.

It should be noted that the first water outlets and the second water outlets are arranged at intervals or in an array.

It should be noted that the partition body divides the water inlet end of the first tube body into a lower water inlet and an upper water inlet. In an embodiment, the partition body is located in the first tube body, and the partition body has a lower surface and an upper surface. The lower surface faces the inclined plane and the upper surface faces away from the inclined plane. The partition body divides the water inlet into a lower water inlet and an upper water inlet, and a connecting surface between the lower surface of the partition body and the lower water inlet is curved, so that a water inlet channel of the lower water inlet has characteristics of narrow mouth contraction.

It should be noted that the other ends of the contraction and diversion pipes are all connected with the connecting pipe, and the connecting pipe is used for merging the water discharged from the multiple contraction and diversion pipes and discharging the water again. When discharged from the connecting pipe, the discharged water may cover the whole inclined plane, so that the inclined plane may be uniformly washed, and uneven discharge of silt at the water outlet end of the first tube body may be prevented.

During the drainage period in the irrigation area, when the displacement is small, the water flow only enters the first tube body through the lower water inlet. When the water depth is lower than the lowest point of the narrow mouth contraction section of the lower water inlet, the water flow flows out of the device by its own weight depending on the inclination angle of the inclined plane, which is less likely to deposit sediment compared with the horizontal drainage bottom plate. When the water depth is higher than the lowest point of the narrow mouth contraction section of the lower water inlet and lower than the upper water inlet, the flow velocity of water through the narrow mouth contraction section increases, which may carry the sediment for a longer distance and reduce the sedimentation. Combined with the design of the inclined plane, the problem of sedimentation near the water inlet end of the first tube body may be solved.

When the displacement is large, the water flows through the upper water inlet and the lower water inlet for drainage. According to the hydraulic principle, the flow velocity of the water flow at the lower water inlet is higher than that at the upper water inlet, and the greater the flow velocity, the smaller the pressure will be. So, part of the sediment coming from the upper water inlet will be transferred downwards due to the pressure difference. However, the flow velocity of the water flow near the water inlet end of the first tube body is faster and the sediment is not easy to deposit, so most of the sediment coming from the lower water inlet will be discharged through the drainage outlet, and a small part will be deposited at the distal end of the water inlet at a reduced rate due to the neutralization of the upper and lower flow velocities and the viscous force of the water flow. By arranging the contraction and diversion device at the drainage end of the first tube body, part of the water flow is collected and then dived into the inclined plane, solving the problem of siltation at the drainage outlet.

According to an embodiment of the present disclosure, the connecting pipe includes a connecting plate, and a disturbance device is provided on the connecting plate. The disturbance device includes a disturbance substrate, and the disturbance substrate is moveable along the connecting plate; a disturbance rod penetrates and is housed in the disturbance substrate. One end of the disturbance rod close to the lower water outlet side is provided with a disturbance diversion plate, and another end of the disturbance rod is provided with disturbance blades.

Through the above design, the connecting pipe includes the connecting plate and the disturbance device, that is, the water discharged from the contraction and diversion pipes is collected through the gap between the connecting plate and the disturbance diversion plate, and the water from the contraction and diversion pipes is further diverted and discharged through the disturbance diversion plate. By the arrangement of the disturbance device, the damage caused by the impact of water discharged from the contraction and diversion pipes on the inclined plane may be prevented, and the service life of the whole device may be prolonged.

It should be noted that since the upper water outlet side has the first water outlets and the second water outlets, when water enters the contraction and diversion device through the first water outlets, there must be water discharged from the second water outlets, and then the water discharged from the second water outlets impact the disturbance device. Specifically, the water discharged from the second water outlets impact the disturbance blades on the disturbance rod, and at this time, the disturbance blades drive the disturbance rod to shake, which in turn drives the disturbance diversion plate to shake. The shaking of the disturbance diversion plate will drive the water flowing from the contraction and diversion pipes to swing, and the part which the water swings towards has greater impact force, and at this time, the scouring and siltation effect at the water outlet end of the first tube body may be improved.

In an embodiment, the connecting plate is provided with a limiting plate, and a first spring is arranged between the limiting plate and the disturbance substrate. The connecting plate is inclined, specifically, the inclination direction of the connecting plate is the same as that of the bottom plate.

When the water displacement is small, that is, when the water enters the first tube body only through the lower water inlet, there is no water impacting the disturbance blades, and in turn, driven by the first spring, the disturbance substrate will retreat to a waterless position. It should be noted that in the waterless position, due to the inclined setting of the connecting plate, the disturbance diversion plate is closer to the contraction and diversion pipes, further providing a space for the lower water outlet side and realizing the smooth drainage of the lower water outlet side.

When the displacement is large, that is, when the water enters the first tube body through the lower water inlet and the upper water inlet, part of the water comes from the second water outlet and impacts the disturbance blades. During this process, the disturbance blades drive the disturbance substrate to move in the compression direction of the first spring, and the disturbance diversion plate moves downward, providing a space for the water from the first water outlets and realizing the diversion of the water from the first water outlets. It should be noted that when the first spring compresses the disturbance diversion plate to a limiting position, the disturbance diversion plate will not contact the inclined plane.

According to an embodiment of the present disclosure, the disturbance diversion plate includes an arc-shaped first diversion plate, and each of two sides of the first diversion plate is provided with a first fixing plate; the first diversion plate is provided with a first diversion hole, and one side of the first diversion hole is provided with a second diversion plate, and each of two ends of the second diversion plate is rotatably connected to the first fixing plate.

Through the above design, a space is formed between the arc-shaped first diversion plate and the connecting plate to realize the confluence of the water from the multiple contraction and diversion pipes and conduct diversion through the first diversion plate. Two sides of the first diversion plate are each provided with the fixing plate, and the fixing plate is used to limit the flow direction of the water and prevent the water from being discharged from the two sides to affect the flow velocity of the water at the lower water outlet side. In addition, the first diversion hole is arranged correspondingly to the second diversion plate, which may realize that when the water impact onto the first diversion plate, the second diversion plate may divert part of the water to the second diversion plate, and the second diversion plate may divert part of the water through the first diversion hole. The second diversion plate is adjustable, that is, the second diversion plate is rotatably connected to the first fixing plate, so that the magnitude and speed of the deflection of the second diversion plate may be adjusted. Through the diversion of the second diversion plate, the scouring and siltation effect may be further improved and the inclined plane may be prevented from being damaged by the impact force of water on the inclined plane.

According to an embodiment of the present disclosure, one side of the first diversion plate away from the first diversion hole is provided with a rubber strip.

Through the above design, when the water flows on the first diversion plate, the rubber strip may realize that there is an upward force during the discharge of the water at the end of the first diversion plate, thereby changing the direction of the impact force and the direction of the speed when the water is discharged, and maintaining the impact force and speed of the water in a suitable range, so as to prevent the water from having a strong impact force on the inclined plane when better scouring and silting is realized, thereby improving the service life of the whole device.

According to an embodiment of the present disclosure, the first diversion plate is provided with rectangular second diversion holes at intervals.

Through the above design, the second diversion holes may realize secondary diversion. It should be noted that the second diversion hole is rectangular, and the length direction of the second diversion hole is the same as the flow direction of the water. Therefore, in the process of diversion of the second diversion holes, the direction of water discharged from the second diversion holes is the same as the direction of water flowing on the inclined plane, which may prevent the water from impacting the inclined plane too much and improve the impact effect of water on silt.

According to an embodiment of the present disclosure, each of two ends of the second diversion plate is provided with a rotating plate, and the rotating plate is rotatably provided on the first fixing plate, and one side of the first fixing plate facing the rotating plate is provided with an adjustment track, and the first fixing plate is arranged correspondingly to the adjustment track.

According to an embodiment of the present disclosure, an adjusting assembly is provided on the adjustment track, and the adjusting assembly includes a first fixing piece arranged on the first fixing plate and a second fixing piece arranged on the rotating plate, and a first elastic piece is provided between the first fixing piece and the second fixing piece.

Through the above design, the second diversion plate may automatically adjust its own pitching angle under the impact of water. Specifically, when the water from the contraction and diversion pipes impacts the first diversion plate, part of the water from the first diversion plate impacts the second diversion plate, and the second diversion plate moves along the adjustment track under the restriction of the first elastic piece.

In an embodiment, the first elastic piece is a spring. In an embodiment, the first elastic piece is an elastic rubber ring.

DETAILED DESCRIPTION OF THE EMBODIMENTS

Figure 1:
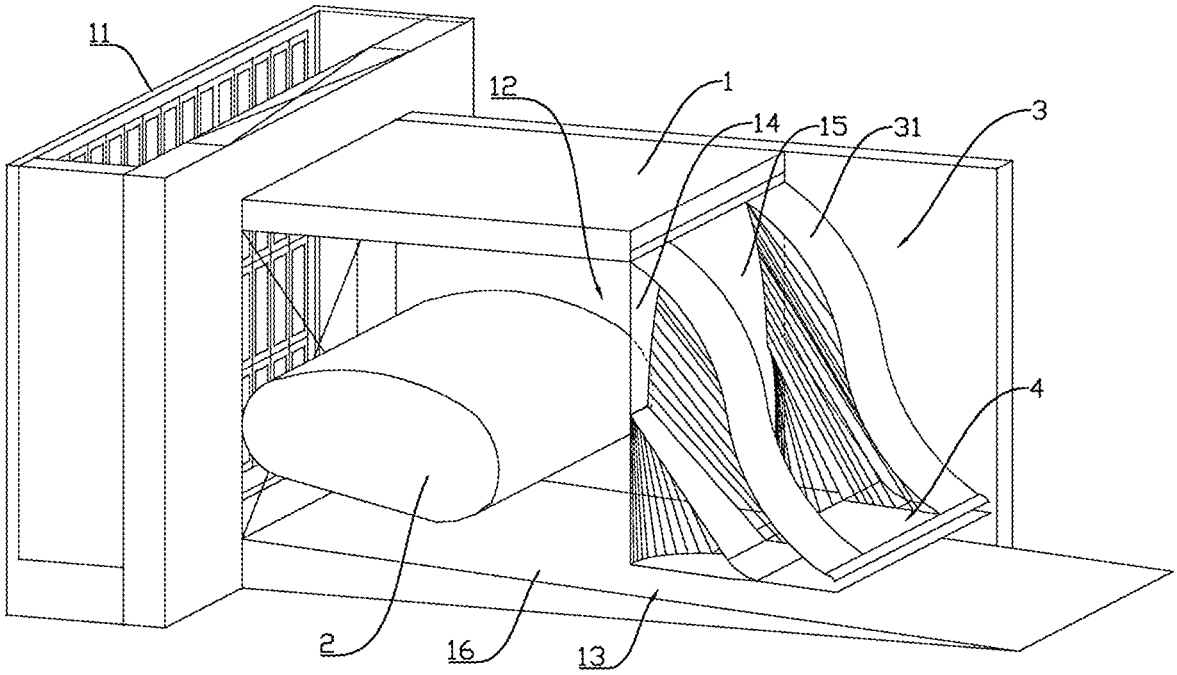
FIG. 1 is a schematic diagram of a self-acting dredging and drainage structure for a plain river network irrigation area.
Figure 2:
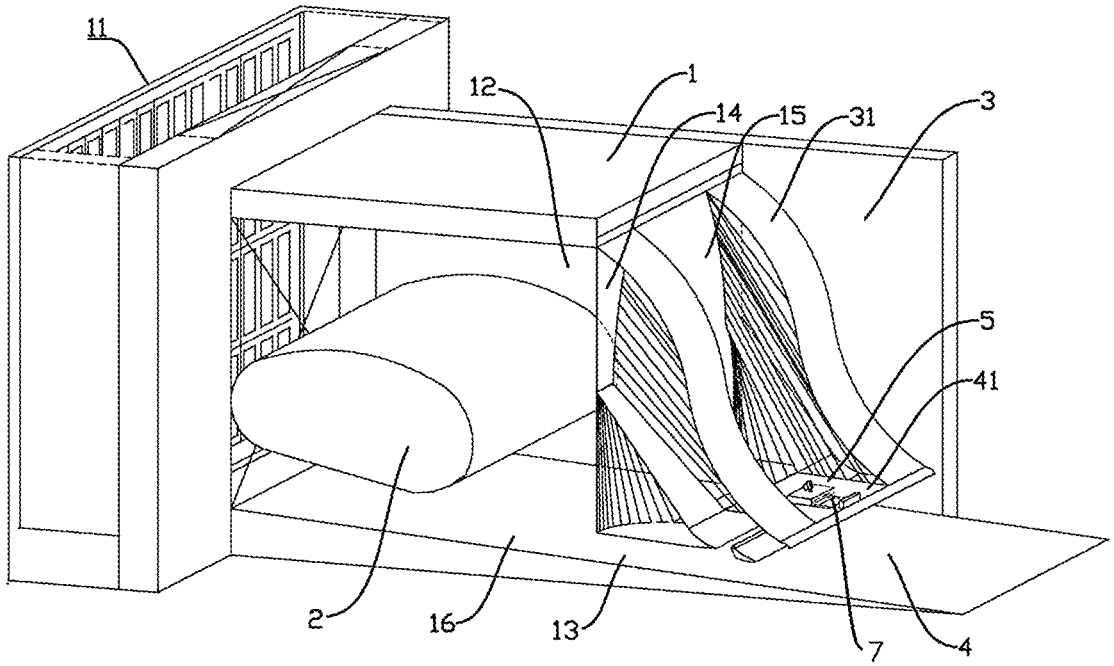
FIG. 2 is a schematic diagram of another self-acting dredging and drainage structure for a plain river network irrigation area with a disturbance device.
Figure 3:
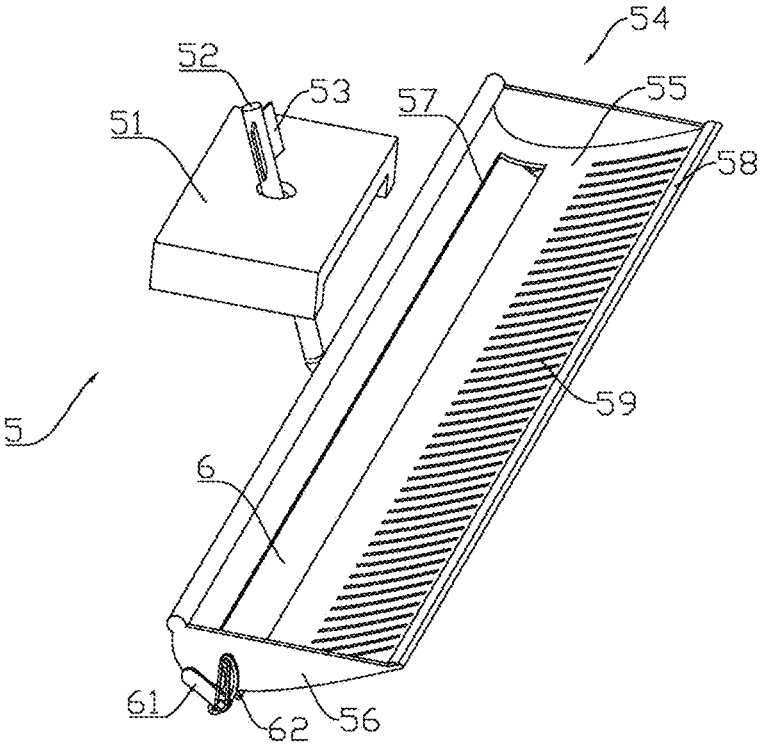
FIG. 3 is a schematic perspective view of the disturbance device.
Figure 4:
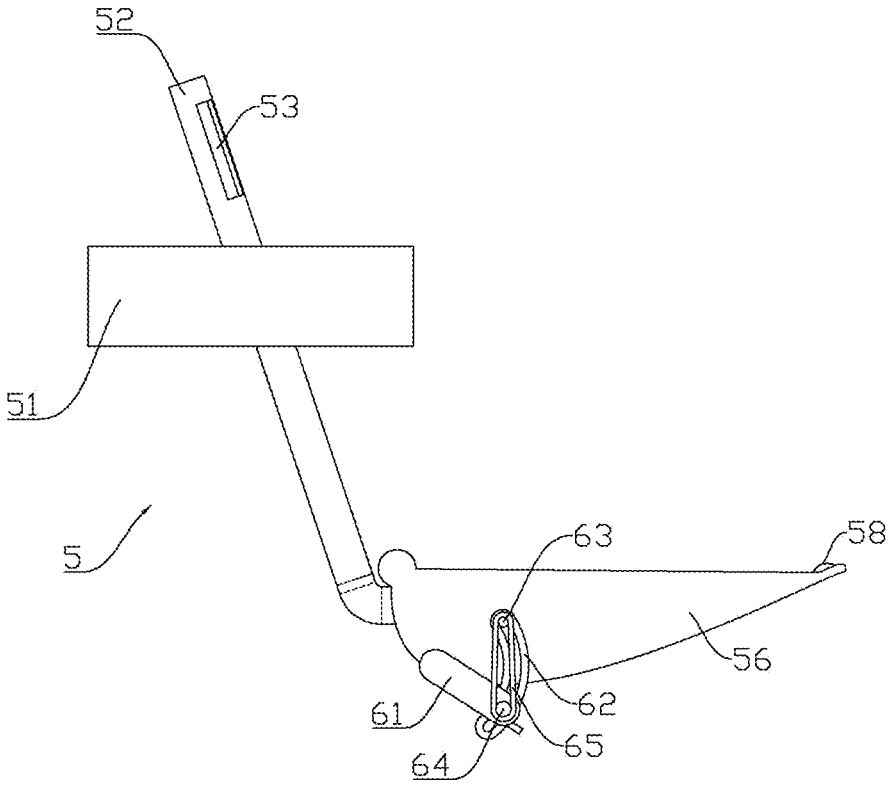
FIG. 4 is a schematic side view of the disturbance device.

The technical solution of the present disclosure will be further described in detail with reference to specific embodiments and drawings.

Embodiment 1

As shown in FIG. 1, FIG. 2, FIG. 3 and FIG. 4, a self-acting dredging and drainage structure for a plain river network irrigation area, including a first tube body 1. A water inlet end side of the first tube body 1 is provided with a trash rack 11, a partition body 2 is provided in the first tube body 1, and a water outlet end side of the first tube body 1 is provided with a contraction and diversion device 3. The contraction and diversion device 3 divides a water outlet end of the first tube body 1 into an upper water outlet side 12 and a lower water outlet side 13, and the contraction and diversion device 3 includes no less than one provided contraction and diversion pipe 31. The upper water outlet side 12 has first water outlets 14 and second water outlets 15, one end of each contraction and diversion pipe 31 is arranged in one-to-one correspondence with the corresponding one of the first water outlets 14, and other ends of the contraction and diversion pipes 31 are all connected with a connecting pipe 4.

A sidewall of the first tube body 1 adjacent to the lower water outlet side 13 has an inclined plane 16.

Through the overall design of the self-acting dredging and drainage structure for the plain river network irrigation area, the trash rack is in front of the water inlet end of the first tube body 1, which may intercept the waste such as leaves and plastics in the irrigation area, prevent the waste from entering the first tube body 1 and blocking the first tube body 1, and the waste may be collected and cleaned manually at intervals. The first water outlets 14 on the upper water outlet side 12 are arranged in one-to-one correspondence with the contraction and diversion pipes 31, so that the water discharged from the first water outlets 14 may be discharged along the contraction and diversion pipes 31. It should be noted that the water outlet of each contraction and diversion pipe 31 faces the drainage direction of the lower water outlet side 13 of the first tube body 1, and the contact surface between an inner wall of each contraction and diversion pipe and the water is in the form of streamlined or parabolic or other forms of slowing down the water flow resistance, which may realize the contact between the water and the pipe wall and improve the flow velocity of the water to the water outlet of each contraction and diversion pipe 31.

It should be noted that the first water outlets 14 and the second water outlets 15 may be arranged at intervals or in an array.

It should be noted that the partition body 2 divides the water inlet end of the first tube body 1 into a lower water inlet and an upper water inlet. In an embodiment, the partition body 2 is located in the first tube body 1, and the partition body 2 has a lower surface and an upper surface The lower surface faces the inclined plane 16 and the upper surface faces away from the inclined plane 16. The partition body 2 divides the water inlet into a lower water inlet and an upper water inlet, and a connecting surface between the lower surface of the partition body 2 and the lower water inlet is curved, so that a water inlet channel of the lower water inlet has characteristics of narrow mouth contraction.

It should be noted that the other ends of the contraction and diversion pipes 31 are all connected with the connecting pipe 4, and the connecting pipe 4 is used for merging the water discharged from the multiple contraction and diversion pipes 31 and discharging the water again. When discharged from the connecting pipe 4, the discharged water may cover the whole inclined plane 16, so that the inclined plane 16 may be uniformly washed, and uneven discharge of silt at the water outlet end of the first tube body 1 may be prevented.

During the drainage period in the irrigation area, when the displacement is small, the water flow only enters the first tube body 1 through the lower water inlet. When the water depth is lower than the lowest point of the narrow mouth contraction section of the lower water inlet, the water flow flows out of the device by its own weight depending on the inclination angle of the inclined plane 16, which is less likely to deposit sediment compared with the horizontal drainage bottom plate. When the water depth is higher than the lowest point of the narrow mouth contraction section of the lower water inlet and lower than the upper water inlet, the flow velocity of water through the narrow mouth contraction section increases, which may carry the sediment for a longer distance and reduce the sedimentation. Combined with the design of the inclined plane 16, the problem of sedimentation near the water inlet end of the first tube body 1 may be solved. When the displacement is large, the water flows through the upper water inlet and the lower water inlet for drainage. According to the hydraulic principle, the flow velocity of the water flow at the lower water inlet is higher than that at the upper water inlet, and the greater the flow velocity, the smaller the pressure will be, so part of the sediment coming from the upper water inlet will be transferred downwards due to the pressure difference. However, the flow velocity of the water flow near the water inlet end of the first tube body 1 is faster and the sediment is not easy to deposit, so most of the sediment coming from the lower water inlet will be discharged through the drainage outlet, and a small part will be deposited at the distal end of the water inlet at a reduced rate due to the neutralization of the upper and lower flow velocities and the viscous force of the water flow. By arranging the contraction and diversion device 3 at the drainage end of the first tube body 1, part of the water flow is collected and then dived into the inclined plane 16, solving the problem of siltation at the drainage outlet.

The connecting pipe 4 includes a connecting plate 41, and the connecting plate 41 is provided with a disturbance device 5. The disturbance device 5 includes a disturbance substrate 51, and the disturbance substrate 51 can move along the connecting plate 41. A disturbance rod 52 penetrates and is housed in the disturbance substrate 51. One end, close to the lower water outlet side 13, of the disturbance rod 52 is provided with a disturbance diversion plate 54, and the other end of the disturbance rod 52 is provided with disturbance blades 53.

Through the above design, the connecting pipe 4 includes the connecting plate 41 and the disturbance device 5, that is, the water discharged from the contraction and diversion pipes 31 is collected through the gap between the connecting plate 41 and the disturbance diversion plate 54, and the water from the contraction and diversion pipes 31 is further diverted and discharged through the disturbance diversion plate 54. By the arrangement of the disturbance device 5, the damage caused by the impact of water discharged from the contraction and diversion pipes 31 on the inclined plane 16 may be prevented, and the service life of the whole device may be prolonged.

It should be noted that since the upper water outlet side has the first water outlets 14 and the second water outlets 15, when water enters the contraction and diversion device 3 through the first water outlets 14, there must be water discharged from the second water outlets 15, and then the water discharged from the second water outlets 15 impact the disturbance device 5. Specifically, the water discharged from the second water outlets 15 impact the disturbance blades 53 on the disturbance rod 52, meanwhile, the disturbance blades 53 drive the disturbance rod 52 to shake, which in turn drives the disturbance diversion plate 54 to shake. The shaking of the disturbance diversion plate 54 will drive the water flowing from the contraction and diversion pipes 31 to swing, and the part which the water swings towards has greater impact force, and at this time, the scouring and siltation effect at the water outlet end of the first tube body 1 may be improved.

In an embodiment, the connecting plate 41 is provided with a limiting plate, and a first spring is arranged between the limiting plate and the disturbance substrate 51. The connecting plate 41 is inclined, in some embodiments, the inclination direction of the connecting plate 41 is the same as that of the bottom plate.

When the displacement is small, that is, when the water enters the first tube body 1 only through the lower water inlet, there is no water impacting the disturbance blades 53, and in turn, driven by the first spring 7, the disturbance substrate 51 will retreat to a waterless position. It should be noted that in the waterless position, due to the inclined setting of the connecting plate 41, the disturbance diversion plate 54 is closer to the contraction and diversion pipes 31, further providing a space for the lower water outlet side 13 and realizing the smooth drainage of the lower water outlet side 13.

When the displacement is large, that is, when the water enters the first tube body 1 through the lower water inlet and the upper water inlet, part of the water comes from the second water outlet 15 and impacts the disturbance blades 53. During this process, the disturbance blades 53 drive the disturbance substrate 51 to move in the compression direction of the first spring 7, and the disturbance diversion plate 54 moves downward, providing a space for the water from the first water outlets 14 and realizing the diversion of the water from the first water outlets 14. It should be noted that when the first spring compresses the disturbance diversion plate 54 to a limiting position, the disturbance diversion plate 54 will not contact the inclined plane 16.

The disturbance diversion plate 54 includes an arc-shaped first diversion plate 55, and two sides of the first diversion plate 55 are each provided with a first fixing plate 56; the first diversion plate 55 is provided with a first diversion hole 57, and one side of the first diversion hole 57 is provided with a second diversion plate 6, and each of two ends of the second diversion plate 6 is rotatably connected to the first fixing plate 56.

Through the above design, a space is formed between the arc-shaped first diversion plate 55 and the connecting plate 41 to realize the confluence of the water from the multiple contraction and diversion pipes 31 and conduct diversion through the first diversion plate 55. Two sides of the first diversion plate 55 are each provided with the fixing plate, and the fixing plate is used to limit the flow direction of the water and prevent the water from being discharged from the two sides to affect the flow velocity of the water at the lower water outlet side 13. In addition, the first diversion hole 57 is arranged correspondingly to the second diversion plate 6, which may realize that when the water impact onto the first diversion plate 55, the second diversion plate 6 may divert part of the water to the second diversion plate 6, and the second diversion plate 6 may divert part of the water through the first diversion hole 57. The second diversion plate 6 is adjustable, that is, the second diversion plate 6 is rotatably connected to the first fixing plates 56, so that the magnitude and speed of the diversion of the second diversion plate 6 may be adjusted. Through the diversion of the second diversion plate 6, the scouring and siltation effect may be further improved and the inclined plane 16 may be prevented from being damaged by the impact force of water on the inclined plane 16.

One side of the first diversion plate 55 away from the first diversion hole 57 is provided with a rubber strip 58.

Through the above design, when the water flows on the first diversion plate 55, the rubber strip 58 may realize that there is an upward force during the discharge of the water at the end of the first diversion plate 55, thereby changing the direction of the impact force and the direction of the speed when the water is discharged, and maintaining the impact force and speed of the water in a suitable range, so as to prevent the water from having a strong impact force on the inclined plane 16 when better scouring and silting is realized, thereby improving the service life of the whole device.

The first diversion plate 55 is provided with rectangular second diversion holes 59 at intervals.

Through the above design, the second diversion holes 59 may realize secondary diversion. It should be noted that the second diversion hole 59 is rectangular, and the length direction of the second diversion hole 59 is the same as the flow direction of the water. Therefore, in the process of diversion of the second diversion holes 59, the direction of water discharged from the second diversion holes 59 is the same as the direction of water flowing on the inclined plane 16, which may prevent the water from impacting the inclined plane 16 too much and improve the impact effect of water on silt.

Two ends of the second diversion plate 6 are each provided with a rotating plate 61, and the rotating plate 61 is rotatably provided on the first fixing plate 56, and one side of the first fixing plate 56 facing the rotating plate 61 is provided with an adjustment track 62, and the first fixing plate 56 is arranged correspondingly to the adjustment track 62.

The adjustment track 62 is provided with an adjusting assembly, and the adjusting assembly includes a first fixing piece 63 arranged on the first fixing plate 56 and a second fixing piece 64 arranged on the rotating plate 61, and a first elastic piece 65 is arranged between the first fixing piece 63 and the second fixing piece 64.

Through the above design, the second diversion plate 6 may automatically adjust its own pitching angle under the impact of water. In some embodiments, when the water from the contraction and diversion pipes 31 impacts the first diversion plate 55, part of the water from the first diversion plate 55 impacts the second diversion plate 6, and the second diversion plate 6 moves along the adjustment track 62 under the restriction of the first elastic piece 65.

In an embodiment, the first elastic piece 65 is a spring. In an embodiment, the first elastic piece 65 is an elastic rubber ring.

Embodiment 2

Figure 5:
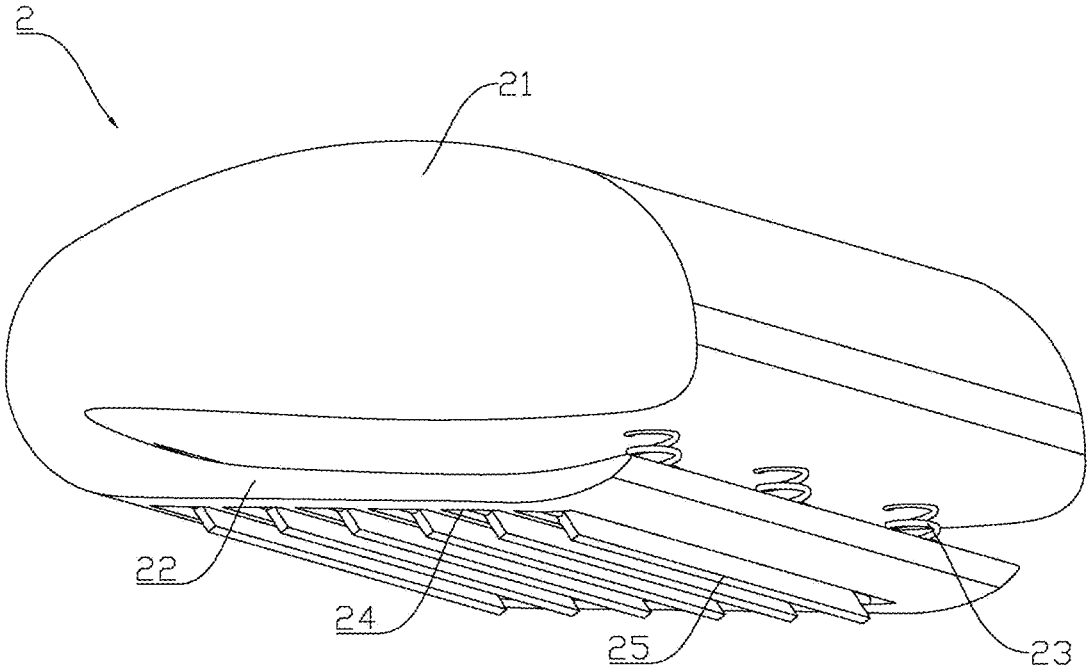
FIG. 5 is a schematic perspective view of a partition body.
Figure 6:
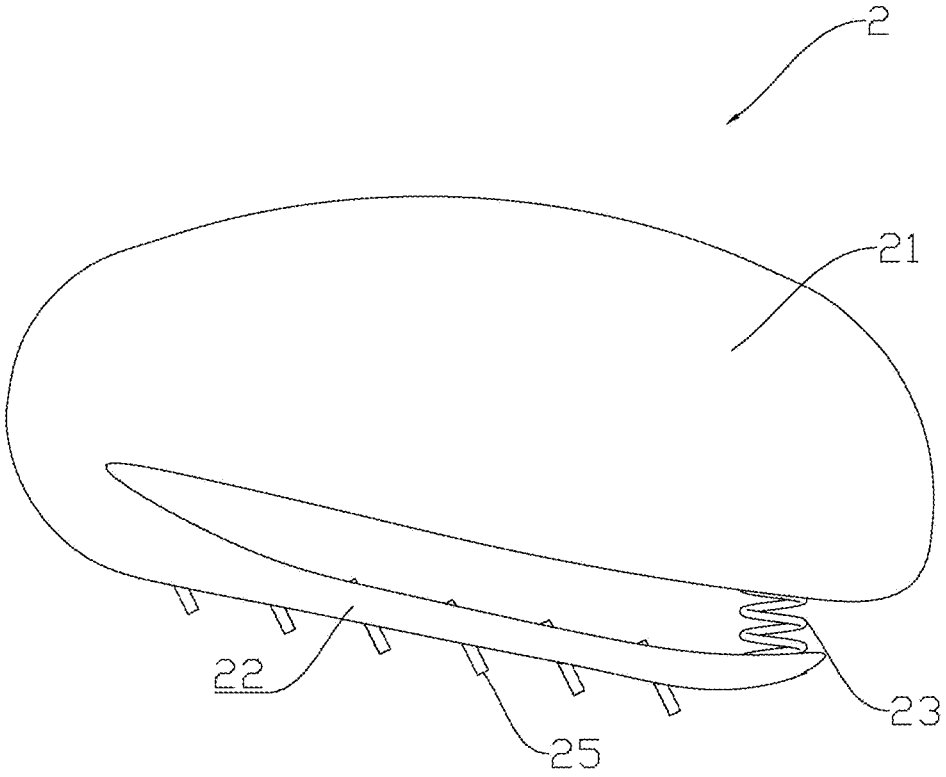
FIG. 6 is a schematic side view of the partition body.
Figure 7:
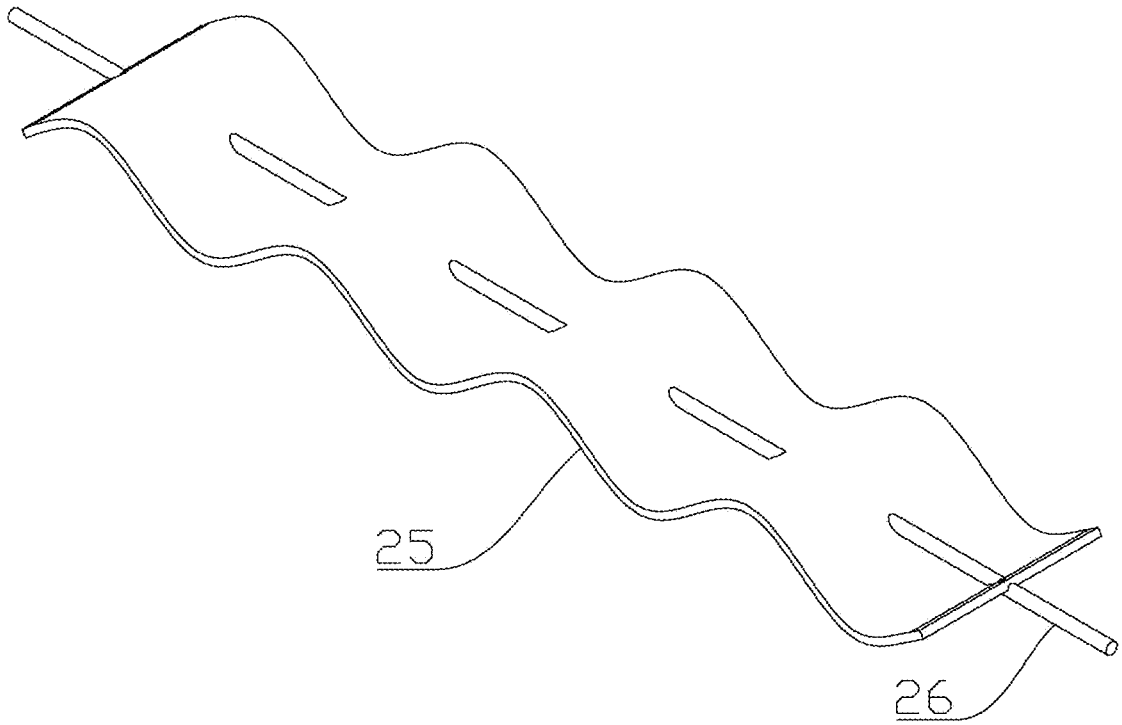
FIG. 7 is a schematic perspective view of a partition plate.

As shown in FIG. 5, FIG. 6 and FIG. 7, a self-acting dredging and drainage structure for a plain river network irrigation area according to another embodiment of the present disclosure is different from Embodiment 1 in that the partition body 2 has a groove. The groove divides the partition body 2 into a first base body 21 and a second base body 22 connected up and down, the first base body 21 is connected to the first tube body 1, and second springs 23 are arranged between the first base body 21 and the second base body 22.

It should be noted that the second base body 22 is connected to the first base body 21, so that elastic movement may occur between the second base body 22 and the first base body 21. Through the above design, when the water flows along the bottom side surface of the second base body 22, the second base body 22 may move under the restriction of the second springs 23 when it is impacted by the water. Therefore, the contact with the upper surface of the water may be achieved according to different flow velocities of water and amount of water, which is conducive to increasing the flow velocity of the water as it flows out of the gap between the second base body 22 and the inclined plane 16.

The second base body 22 is provided with partition holes 24 at intervals, and a partition plate 25 is arranged in each of the partition holes 24, and a rotating shaft 26 passes through the partition plate 25, and the rotating shaft 26 is arranged correspondingly to both sides of the partition hole 24.

It should be noted that the rotating shaft 26 penetrates the partition plate 25, and the quality of the partition plate 25 on two sides of the rotating shaft 26 is uneven, so that the orientation of the partition plate 25 has a specific inclination angle. Moreover, the rotating shaft 26 has a function of limiting the rotation angle under the action of the second base body 22, that is, the rotation angle of the partition plate 25 is limited.

Through the above design, when the water flows through the second base body 22, the partition plates 25 on the second base body 22 may increase bubbles in the water. The angle of the partition plate 25 may be self-adjusted according to the flow velocity of the water. In some embodiments, when the amount of water is small, the angle of the partition plate 25 is large; when the amount of water is large, the angle between the partition plate 25 and the bottom side surface of the second base body 22 is small. Regardless of the amount of water, the water may be contacted with the partition plate 25 to increase bubbles in the water. When there are bubbles in the water, the scouring and siltation effect may be improved.

The partition plate 25 includes a corrugated plate, and the corrugated plate is in a wavy pattern. The corrugated plate is made of rubber.

The waving corrugated plate may realize the change of the shape of the partition plate 25 under the impact of water. In some embodiments, the partition plate 25 will become flat along the length direction of the partition plate 25 with the increase of the flow velocity of water, the angle between the bottom side surface of the second base body and the partition plate 25 gradually decreases with the increase of the water flow velocity, and the partition plate 25 gradually moves in the direction of adhering to the bottom side surface of the second substrate. Through the above design, when the flow of the water is small, the corrugated plate may concentrate the water flow and improve the impact effect on the silt; when the flow of the water is large, the flat partition plate 25 will increase the cross-sectional area. In some embodiments, it will increase the cross-sectional area between the second base body 22 and the inclined plane 16, thereby improving the efficiency of water inflow and the scouring and siltation effect.

The embodiments described above explain the technical solution of the present disclosure in detail. It should be understood that the embodiments described above are only specific embodiments of the present disclosure, and are not used to limit the present disclosure. Any modification, supplement or similar substitution within the scope of the principles of the present disclosure should be included in the protection scope of the present disclosure.

What is claimed is:

1. A self-acting dredging and drainage structure for a plain river network irrigation area, comprising: a first tube body, wherein a water inlet end side of the first tube body is provided with a trash rack, a partition body is provided in the first tube body, and a water outlet end side of the first tube body is provided with a contraction and diversion device; wherein the contraction and diversion device divides a water outlet end of the first tube body into an upper water outlet side and a lower water outlet side, and the contraction and diversion device comprises contraction and diversion pipes arranged no less than one; the upper water outlet side has first water outlets and second water outlets, ends of the contraction and diversion pipes are arranged in one-to-one correspondence with the first water outlets, and other ends of the contraction and diversion pipes are all connected with a connecting pipe.

2. The self-acting dredging and drainage structure for the plain river network irrigation area according to claim 1, wherein a sidewall of the first tube body adjacent to the lower water outlet side has an inclined plane.

3. The self-acting dredging and drainage structure for the plain river network irrigation area according to claim 1, wherein the connecting pipe comprises a connecting plate, and a disturbance device is provided on the connecting plate; the disturbance device comprises a disturbance substrate, and the disturbance substrate is movable along the connecting plate; a disturbance rod penetrates and is housed in the disturbance substrate, wherein one end of the disturbance rod close to the lower water outlet side is provided with a disturbance diversion plate, and an other end of the disturbance rod is provided with disturbance blades.

4. The self-acting dredging and drainage structure for the plain river network irrigation area according to claim 3, wherein the disturbance diversion plate comprises an arc-shaped first diversion plate, and each of two sides of the first diversion plate is provided with a first fixing plate; the first diversion plate is provided with a first diversion hole, and one side of the first diversion hole is provided with a second diversion plate, and each of two ends of the second diversion plate is rotatably connected to the first fixing plate.

5. The self-acting dredging and drainage structure for the plain river network irrigation area according to claim 4, wherein one side of the first diversion plate away from the first diversion hole is provided with a rubber strip.

6. The self-acting dredging and drainage structure for the plain river network irrigation area according to claim 4, wherein the first diversion plate is provided with rectangular second diversion holes at intervals.

7. The self-acting dredging and drainage structure for the plain river network irrigation area according to claim 4, wherein each of two ends of the second diversion plate is provided with a rotating plate, and the rotating plate is rotatably provided on the first fixing plate; one side of the first fixing plate facing the rotating plate is provided with an adjustment track, and the first fixing plate is arranged correspondingly to the adjustment track.

8. The self-acting dredging and drainage structure for the plain river network irrigation area according to claim 7, wherein an adjusting assembly is provided on the adjustment track, and the adjusting assembly comprises a first fixing piece arranged on the first fixing plate and a second fixing piece arranged on the rotating plate, and a first elastic piece is provided between the first fixing piece and the second fixing piece.

* * * * *